US005171049A

United States Patent [19]

Grandy, Sr. et al.

[11] Patent Number: 5,171,049

[45] Date of Patent: Dec. 15, 1992

[54] KEY-IN KNOB DOOR ASSEMBLY WITH NOTCHED TURN BAR SELF-ALIGNING BUTTON AND INSTALLATION CATCHES

[76] Inventors: Kenneth N. Grandy, Sr., 1330 Michigan Ave., South Milwaukee, Wis. 53172; Dennis Resch, W149N8347 Norman Dr., Menomonee Falls, Wis. 53051

[21] Appl. No.: 702,256

[22] Filed: May 17, 1991

Related U.S. Application Data

[63] Continuation-in-part of Ser. No. 593,442, Oct. 5, 1990.

[51] Int. Cl.[5] ..... E05C 1/16

[52] U.S. Cl. ..... 292/336.3; 292/357; 292/DIG. 64

[58] Field of Search ..... 70/221-224, 70/367-372, 451, 461, 466; 292/348-350, 352, 353, DIG. 53, DIG. 60, DIG. 64, 357

[56] References Cited

U.S. PATENT DOCUMENTS

| | | | |
|---|---|---|---|
| 671,943 | 4/1901 | Smith | 292/353 |
| 2,008,668 | 7/1935 | Gold | 70/224 |
| 2,027,731 | 1/1936 | Holpfer | 70/224 |
| 2,079,583 | 5/1937 | Brauning | 70/368 X |
| 2,207,143 | 7/1940 | Brauning | 70/221 X |
| 2,683,367 | 7/1954 | Hillgren | 70/216 |
| 2,726,891 | 12/1955 | Gresham et al. | 70/224 X |
| 2,804,334 | 8/1957 | Schlage et al. | 70/451 |
| 2,929,649 | 3/1960 | Coe | 70/451 X |
| 3,019,633 | 2/1962 | Russell et al. | 70/224 |
| 3,048,436 | 8/1962 | Schiowitz | 70/451 X |
| 3,220,231 | 11/1965 | Wilson | 70/451 X |
| 3,434,316 | 3/1969 | Neary | 70/369 X |
| 3,793,857 | 2/1974 | Schlage | 70/368 |
| 3,853,341 | 12/1974 | MacDonald | 292/171 |
| 3,992,908 | 11/1976 | Crepinsek | 70/370 |
| 4,484,462 | 11/1984 | Berkowitz | 70/224 X |
| 4,631,944 | 12/1986 | Gater et al. | 70/223 X |
| 4,976,480 | 12/1990 | Dixon et al. | 292/353 |

*Primary Examiner*—Richard E. Moore

[57] ABSTRACT

A lockable door seat assembly having two assemblies which are insertable from either side of a door opening for temporary engagement until permanent securing means has been assembled. The door set also includes means for translating the turn bar using available household tools to release the cylinder lock for substitution without removing the lock set from the door. Assembly of the turn bar and cylinder lock are facilitated by a turn button adaptor projection which projection does not interfere with normal door set operation.

10 Claims, 11 Drawing Sheets

FIG. 6
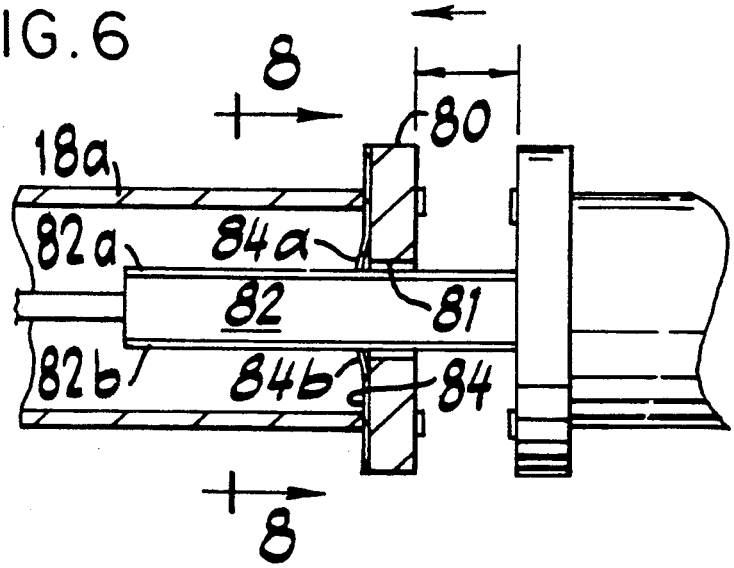
FIG. 7
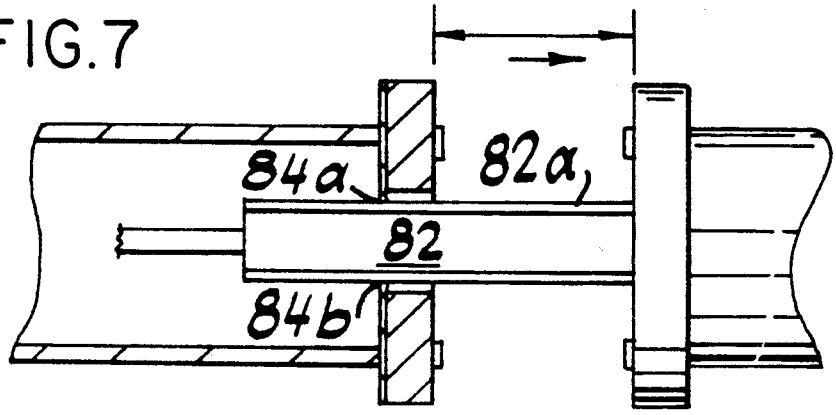
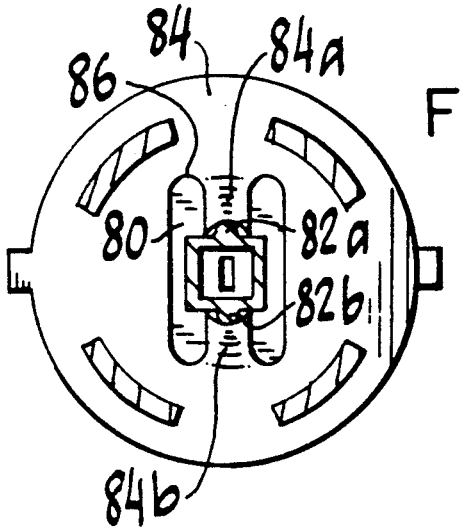
FIG. 8

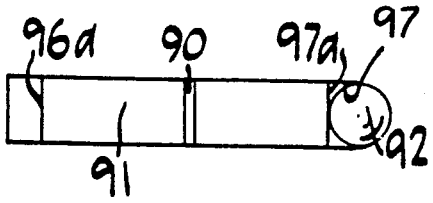
FIG. 12
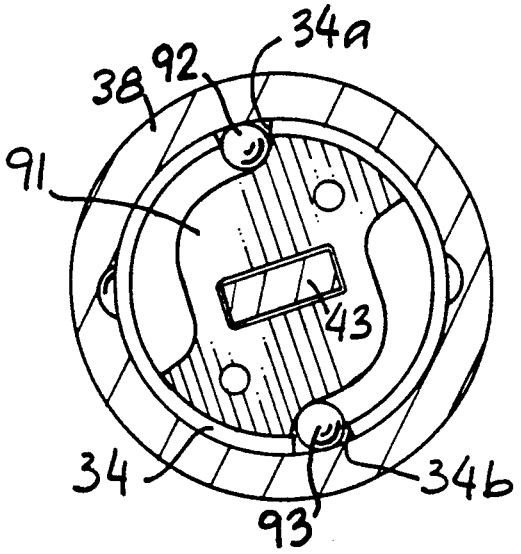
FIG. 12a
FIG. 13
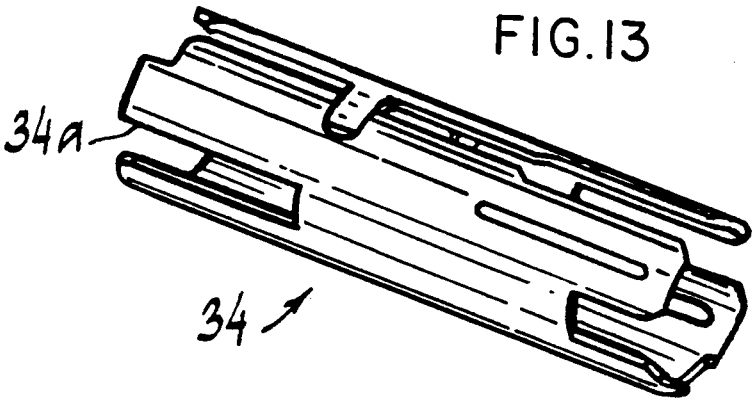

KEY-IN KNOB DOOR ASSEMBLY WITH NOTCHED TURN BAR SELF-ALIGNING BUTTON AND INSTALLATION CATCHES

This application is a continuation-in-part of application Ser. No. 07/593,442, filed Oct. 5, 1990.

BACKGROUND OF THE INVENTION

Prior lock constructions have included arrangements for disengaging the lock cylinder plug from the turn bar including insertion of a tool when disengagement is desired. Exposed apertures have been proposed to receive such tools (U.S. Pat. Nos. 2,008,668, 2,027,731, 2,079,588, 3,019,633). Door sets including two such assembled have been proposed to be brought together from either side of a door and held in permanent engagement using interengaging prongs mounted on the subassemblies (U.S. Pat. Nos. 671,943, 2,726,891, 2,929,649, 3,048,436, 3,853,341). U.S. Pat. No. 3,048,436 states that subassemblies can be separated after permanent engagement using a strong pulling force which may cause damage. Security of such a lock is compromised.

SUMMARY OF THE INVENTION

Broadly, the present invention comprises two door set subassemblies having an interior turn button mounted in a sleeve and an outside cylinder lock with said button and lock interconnected by a turn bar. Subassemblies are held temporarily together by flexible catches, friction or otherwise during initial assembly pending permanent and secure engagement to the door using fasteners. The door set includes a cylinder plug which is separated from the turn bar using a tool insertable through an aperture normally concealed by a knob.

It is also a feature of the invention that the turn button is initially properly positioned during factory assembly with a frangible projection through an alignment hole in the sleeve.

RELATED APPLICATION

This application is a continuation-in-part of U.S. application Ser. No. 07/593,442, filed Oct. 5, 1990.

BRIEF DESCRIPTION OF THE DRAWINGS

FIG. 6, is a plan view showing subassembly halves interconnected with the right half moving to the left;

FIG. 7 is a similar view of FIG. 6 with the right half moving to the right;

FIG. 8 is an enlarged sectional view taken along line 8—8 of FIG. 6;

FIG. 12 is a sectional view along line 13—13 of FIG. 11*a;*

FIG. 12*a* is a view in which the sleeve, cam and turn bar are turned from the FIG. 10 position clockwise about 70°;

FIG. 13 is a perspective view of the sleeve.

DESCRIPTION OF THE PREFERRED EMBODIMENT

Figure 1:
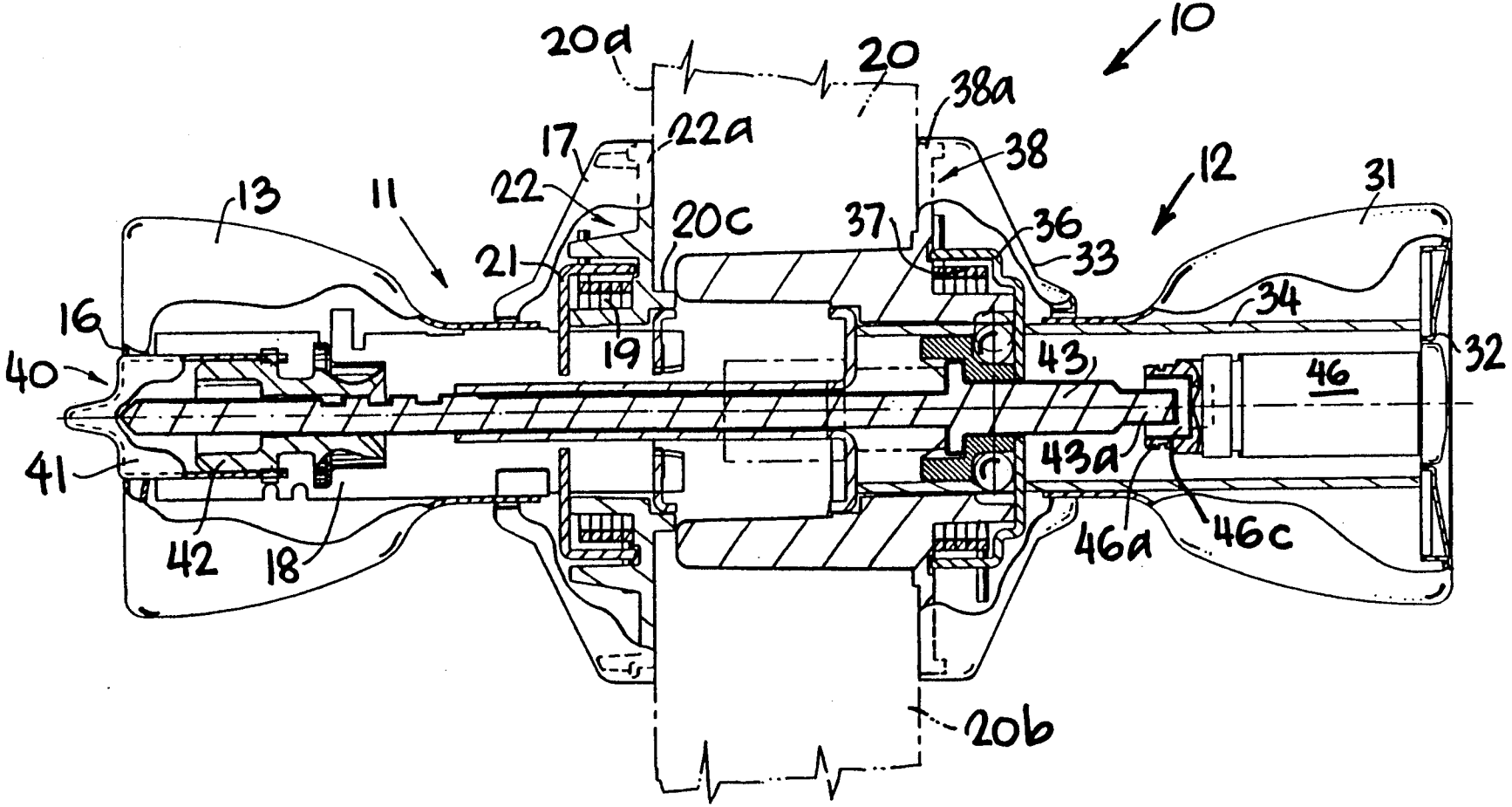
FIG. 1 is a top view of the door set mechanism.
Figure 2:
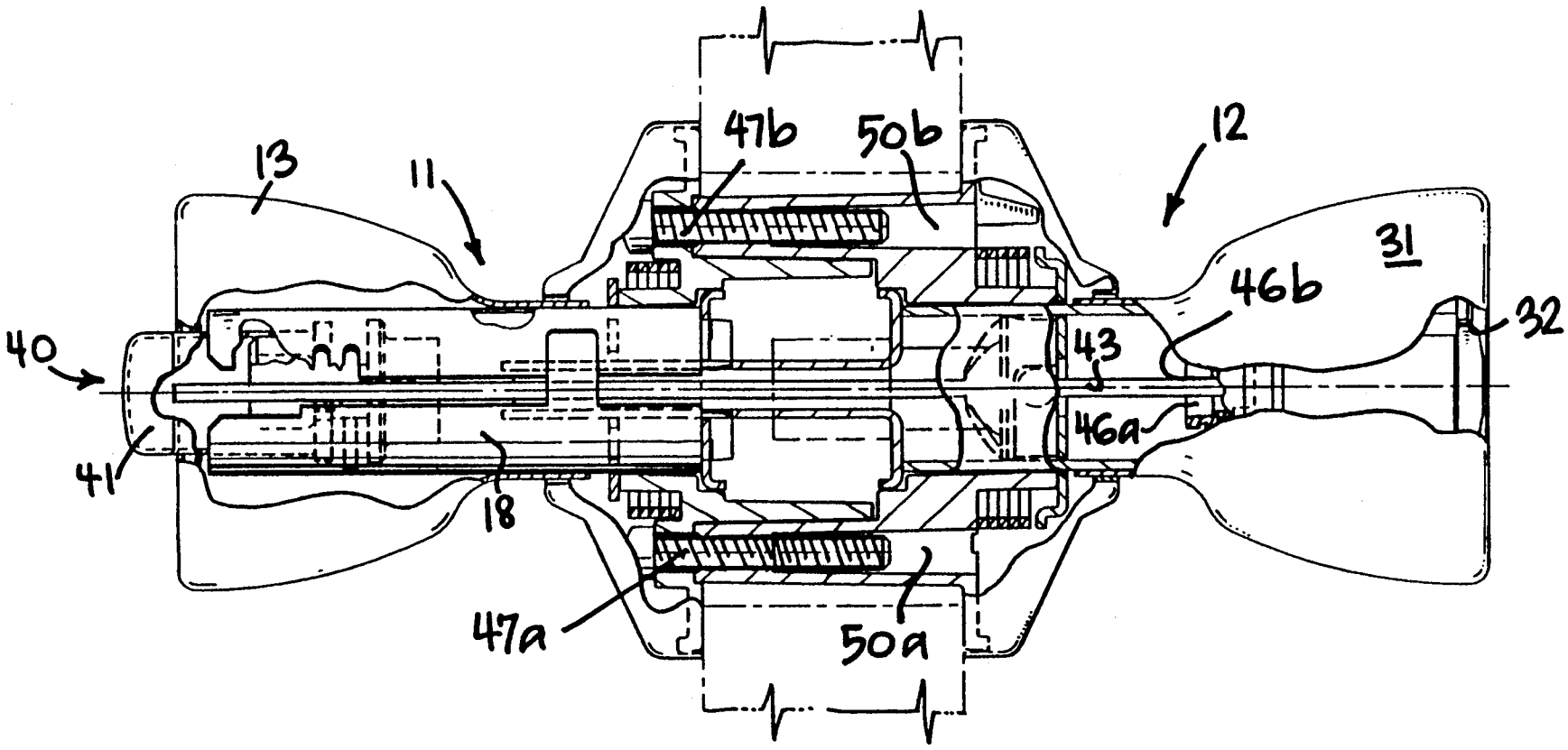
FIG. 2 is an elevational view of the mechanism.

In FIGS. 1 and 2, knob door set assembly 10 includes inside subassembly 11 and outside subassembly 12. Inside subassembly 11 includes inside knob 13 with turn button hole 16, inside boss 17 or rosette, inside sleeve 18, inside spring driver 21, spring 19 and inside housing 22 including housing plate 22*a* for engagement against inside door surface 20*a* of door 20 when the subassemblies are finally installed.

Outside subassembly 12 includes outside knob 31 with lock opening 32, outside boss or rosette 33, outside sleeve 34, outside spring driver 36, spring 37 and outside housing 38 including housing plate 38*a* for engagement against outside surface 20*b* of door 20 when finally installed.

Also shown in FIGS. 1 and 2 are turn button 40 including cap 41 positioned to surround a portion of turn button adapter 42, turn bar 43, cylinder lock 46, cylinder plug 46*a* having slot 46*b* and fasteners 47*a*, 47*b* which are threaded into outside rigid threaded plate projections 50*a*, 50*b* to accomplish permanent installation.

Figure 3A:
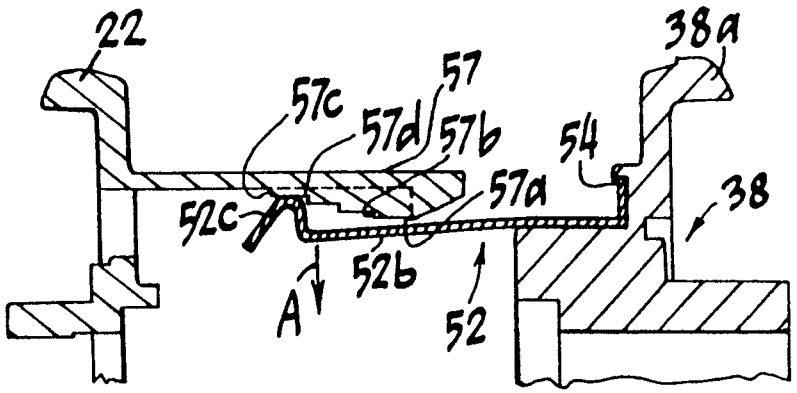
FIG. 3*a* is a sectional view along line 3*a*—3*a* of FIG. 3.
Figure 3:
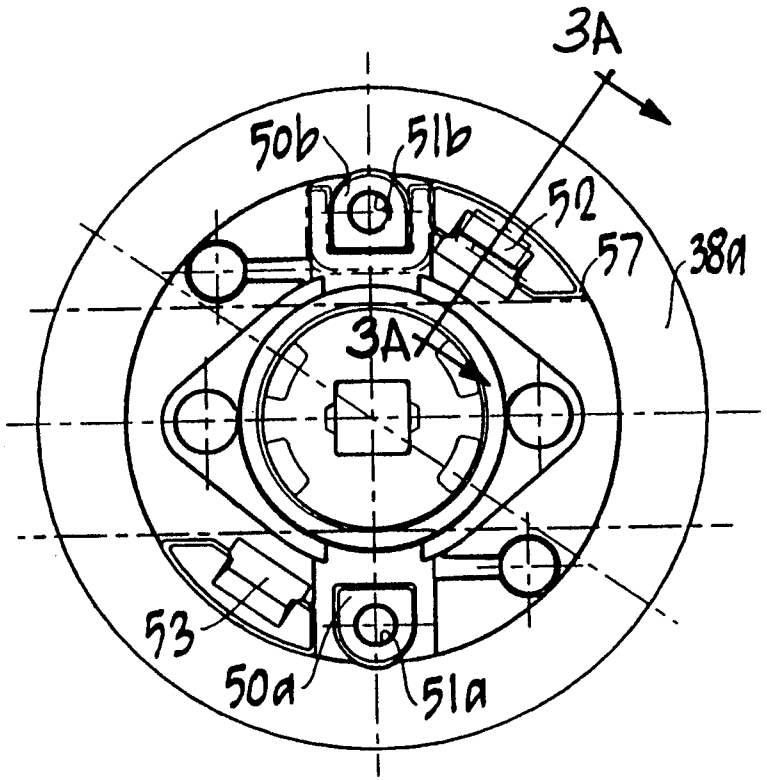
FIG. 3 is an end view of the outside subassembly.

Turning to FIG. 3, outside housing plate 38*a* has two flexible spring projections 52, 53 mounted by staking in plate recesses 54, 55 in plate 38*a* of plate housing 38. Flexible projection 52 includes foot 52*a*, leg 52*b* and U-shaped head 52*c*. Inside plate 22 has rigid grooved projections 57, 58 formed therein which projections 57, 58 each have five (5) stop surfaces 57*a–e*, 58*a–e* for engaging heads 52*c*, 53*c* to hold plates 22, 38 in selected spaced apart distances depending on the thickness of door 20. Door width may, for example, vary from $1\frac{1}{4}$ to $1\frac{3}{4}$ inches. When subassemblies 11 and 12 are first inserted through door opening 20*c* (FIG. 1) flexible projections 52, 53 and corresponding grooved rigid projections 57, 58 engage as heads 52*c*, 53*c* ride down stepped and spaced-apart stop surfaces 57*a–e*, 58*a–e* (see FIG. 3*a*). In one of these positions plates 22, 38 are spaced for engagement or near engagement with door surfaces 20*a*, 20*b*. As further installation continues the two subassemblies are acted up by forces of gravity, vibration of the installer's tool engagement and other forces which could cause either or both subassemblies 11 or 12 to fall to the floor absent the above-described restrain. The engagement of heads 52*c*, 53*c* with first stops 57*e*, 58*e* as the subassemblies separate during installation and plates 22, 38 move slightly away from the door surfaces 20*a*, 20*b*, the resistance forces to permit heads 52*c*, 53*c* to pass stops 57*e*, 58*e* are light and are in the magnitude of a pound or less. This arrangement provides only for temporary engagement of subassemblies 11 and 12 until fasteners 47*a*, 47*b* are in place.

Figure 4A:
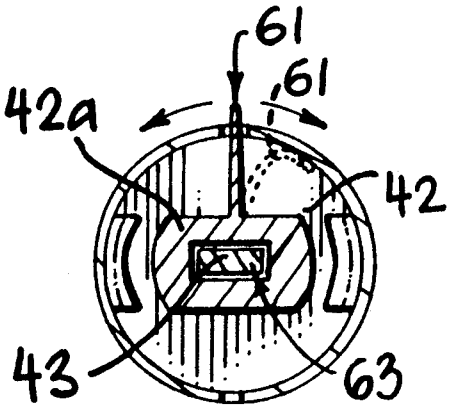
FIG. 4*a* is a sectional view taken along line 4*a*—4*a* of FIG. 4.
Figure 4:
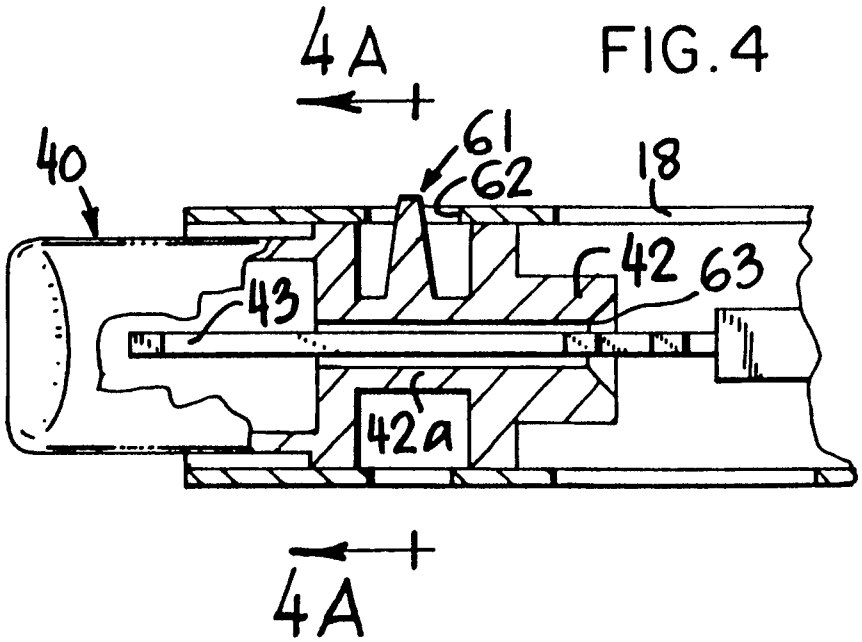
FIG. 4 is a plan view of the sleeve and turn button.

FIGS. 4 and 4*a* show button adaptor 42 including body alignment projection 61 and inside sleeve aperture 62 through which projection 61 which projects from button throat 42*a* when assembled at the factory and during initial assembly. The insertion of the projection 61 in the sleeve aperture 62 assures that rectangular button recess 63 is oriented properly to receive rectangular turn bar 43 during assembly of the subassemblies 11,12. It is seen that rectangular recess 63 has its long sides in a horizontal plane when projection 61 is in opening 62. In this orientation bar 43 may enter recess 63 during assembly. After assembly rotation of button 40 is readily allowed by flexing of projection 61 as shown in FIG. 4*a* in dashed lines (FIG. 8).

Figure 5:
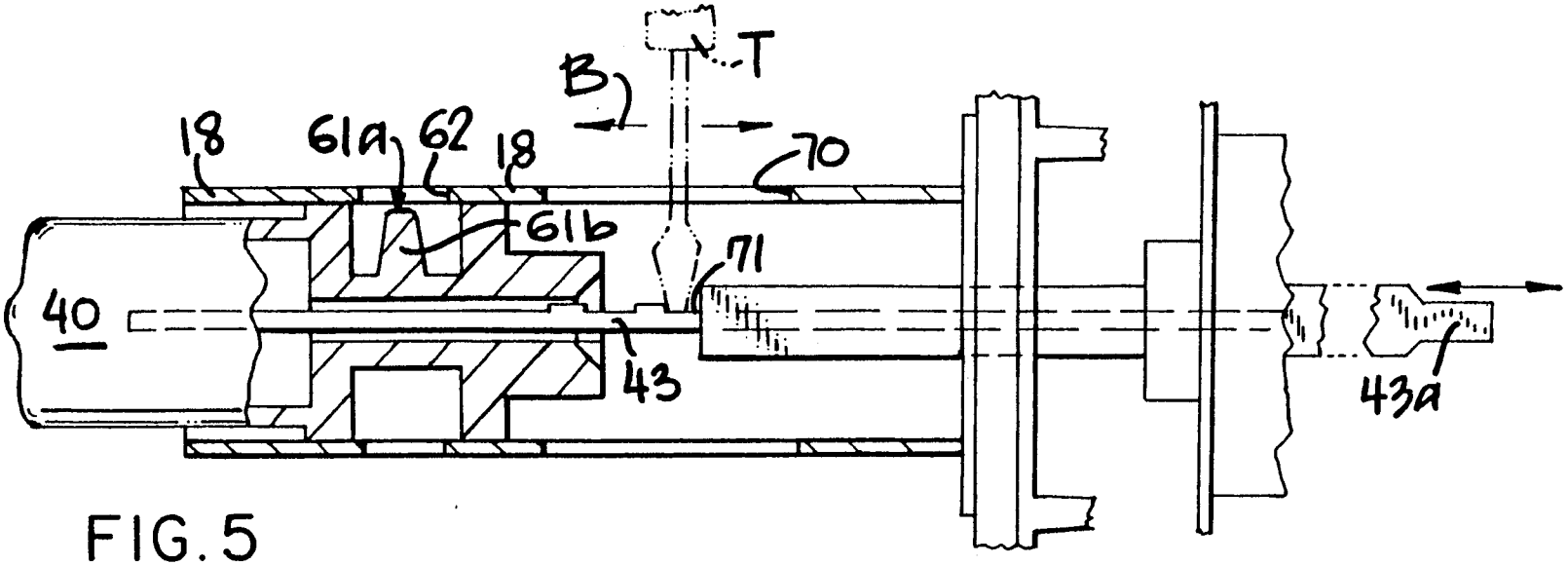
FIG. 5 is a plan view showing turn bar movement with a tool.

In FIG. 5, turn bar 43 is shown being translated away (arrow B) from the cylinder lock 46 to permit removal and replacement of the cylinder plug 46*a*. An aperture 70, having a substantial width, such as 3/8 inch and having a substantial length, such a ¾ inch, in inside sleeve 18 permits insertion of a common tool (T), such as a household screw driver, where turn bar notches 71 serve to allow translation of bar 43 against tension spring (not shown) to allow bar end 43*a* to move out of slot 46*c* in lock plug 46*a* (see also FIG. 1). Aperture 70 is normally concealed from view by knob 13 and/or boss 27 which are removable to permit tool(s) insertion. Once turn bar 43 is so withdrawn the lock plug 46*a* and lock 46 can be readily removed for replacement with a new lock plug. Also shown in FIG. 5 is an alignment projection 61A which is the same height of projection 61; however, projection 61A is made of a different material or with a modified thickness so that it snaps off during operation after assembly, leaving base portion 61*b*. Thus, projections 61, 61A do not interfere with regular door set operation after assembly is complete.

Turning to FIGS. 6–8, an alternative embodiment is shown in which inside sleeve 18*a* has circular end plate 80 secured to it. Plate 80 has rectangular opening 81 for receiving rectangular spindle 82. Spindle 82 has top and bottom ridge projections 82*a*, 82*b*. After spindle 82 passes through opening 81 it passes through adjacent flex friction washer 84 which has opening 86 into which are projected upper and lower washer tongues 84*a*, 84*b* which ride on projections 82*a*, 82*b* and which resist the withdrawal of friction or jam into opening 81 or both (see FIG. 8).

Figure 9:
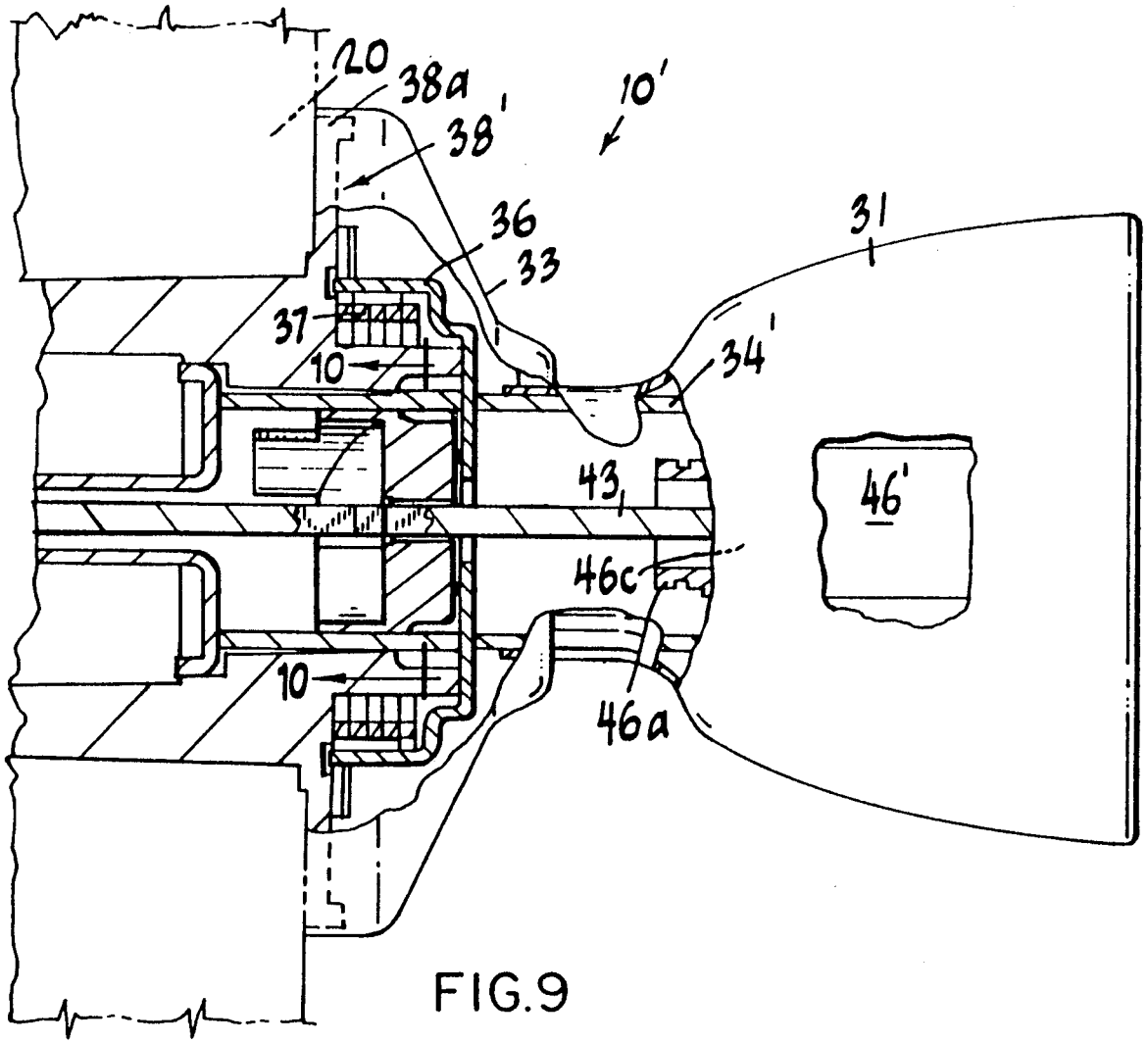
FIG. 9 is a partial view similar to FIG. 1 showing turn bar turned 90°.
Figure 10:
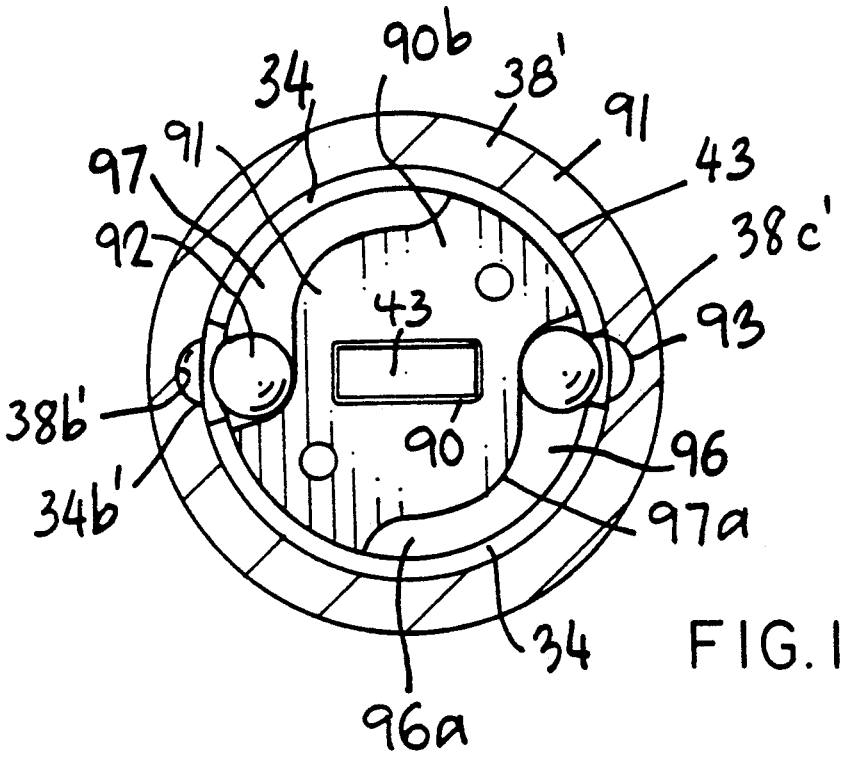
FIG. 10 is a sectional view taken along line 10—10 of FIG. 9.
Figure 11:
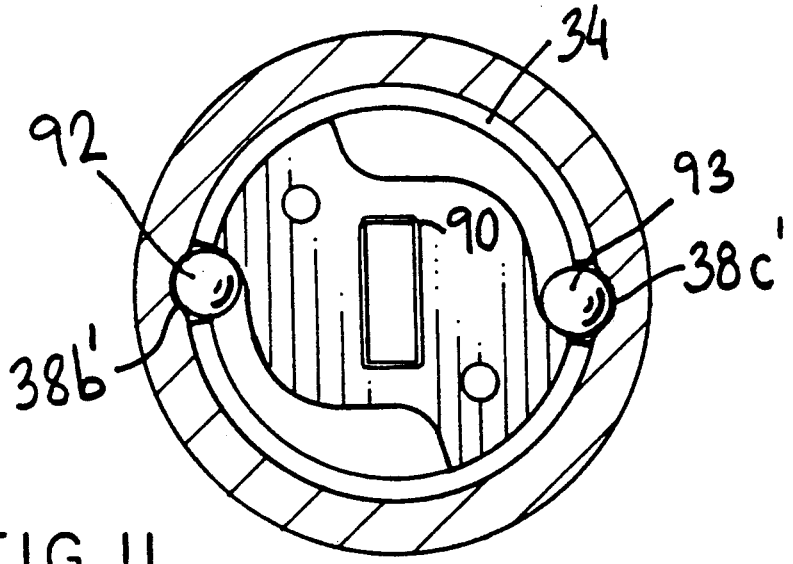
FIG. 11 is a view similar to FIG. 10 in which the bar and cam are turned 90° clockwise.
Figure 11A:
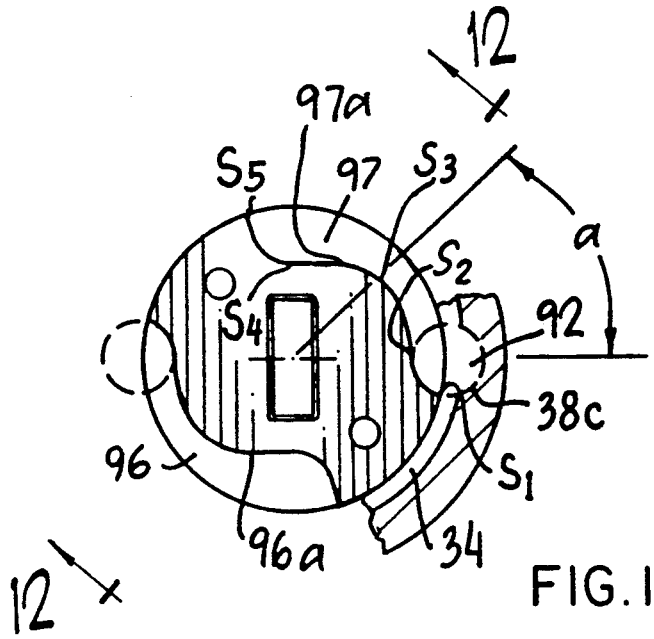
FIG. 11*a–c* are partial sectional views showing the lock position and the cam thereafter rotated through angle "a"

In another alternative embodiment, lock assembly 10' is unlocked by operating the key (not shown) to place cylinder lock 46' in a condition in which turn bar 43 is positioned in its vertical position in its lock position (FIGS. 11 and 11*a*). Since turn bar 43 is inserted in rectangular opening 90 in locking cam 91, turn bar 43 and cam 90 turn together at all times. As shown in FIG. 10, the unlock position, lock balls 92, 93 are positioned adjacent but opposite body cavities 38*b'*, 38*c'*. Cam 91 includes cam body 90*a* and cam ball-engaging recesses 96, 97 and cam profile surfaces 96*a*, 97*a*. Also shown in FIG. 9 is spring driver 36, housing 38' and sleeve 34.

When key operation places cylinder lock 46' in a condition in which turn bar 43 and locking cam 91 are turned 90° clockwise, from an unlocked position as viewed in FIG. 10 to a locked position of FIG. 11, balls 92, 93 are driven horizontally and outwardly into cavities 38*b'*, 38*c'* by cam profile surfaces 96*a*, 97*a* which deliminate in part ball recesses 96, 97 to place the lock assembly 10 in the lock position (see also FIG. 11). Sleeve 34 does not turn during such key operation.

Figure 11B:
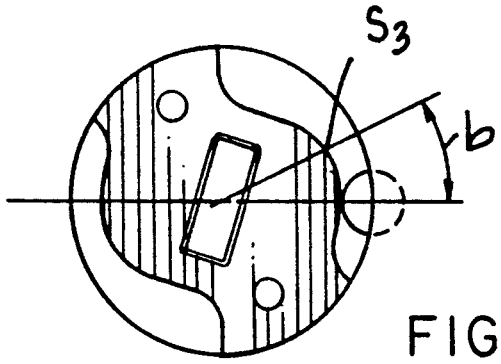
Figure 11C:
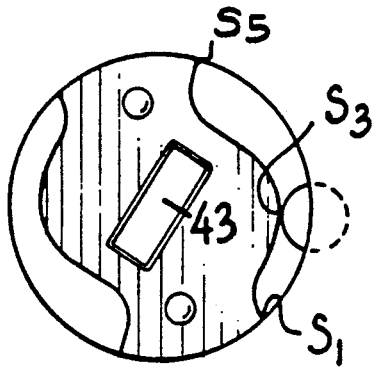

With respect to FIGS. 11*a–c*, the profile cam surface 97*a* includes four (4) segments: $S_1$ to $S_2$; $S_2$ to $S_3$; $S_3$ to $S_4$; and $S_4$ to $S_5$. In the lock portion, ball 92 nests in segments $S_1$, $S_2$ and as cam 91 rotates clockwise, ball 92 stays equidistant from profile cam surface 97*a* of cam 91 through arcuate segment rotation equal to the length of segment $S_2$–$S_3$ and thereafter ball 92 and cam surface 97*a* increase in spacing, all to allow ball 92 to move further out of cavity 38*c*. The tolerances and clearances among ball 92, cavity 38*c* and cam 91 are such that ball 92, during the fully locked position, can move horizontally about 0.010 inch. FIG. 11*c* shows the fully locked position; FIG. 11*b* shows cam 91 turned to reduce angle "a" of FIG. 11*a* to "b"; and FIG. 11*c* shows the cam turned to reduce such angle to zero. FIG. 12 is a sectional view showing ball 92 adjacent profile surface 97*a* of ball pocket 90*b*. Angle "a" is preferably about 30°–35°.

Due to the clearance and tolerance among parts of assembly 10' vibration and tampering can cause cam 91 to turn up to 15°–20° even when the lock is in the lock position. Since balls 92, 93 are held in their respective cavities during the initial 30°–35° of cam 91 rotation, the lock maintains its integrity even when vibrated or torqued by tampering to the maximum arc allowed by clearance and tolerance of such parts.

When lock assembly 10' is in its unlock position knob 31 is free to rotate along with sleeve 34 clockwise (as viewed from the outside of the assembly) about 80° with balls 92, 93 captured in sleeve apertures 34*a*, 34*b* (FIG. 12*a*). FIG. 13 shows sleeve aperture 34*a*. Sleeve aperture 34*b'* is positioned 180° opposite to aperture 34*a'* (not shown). When the door operator releases knob 31, spring 37 causes sleeve 34 to rotate to position itself as shown in FIG. 10.

Figure 14:
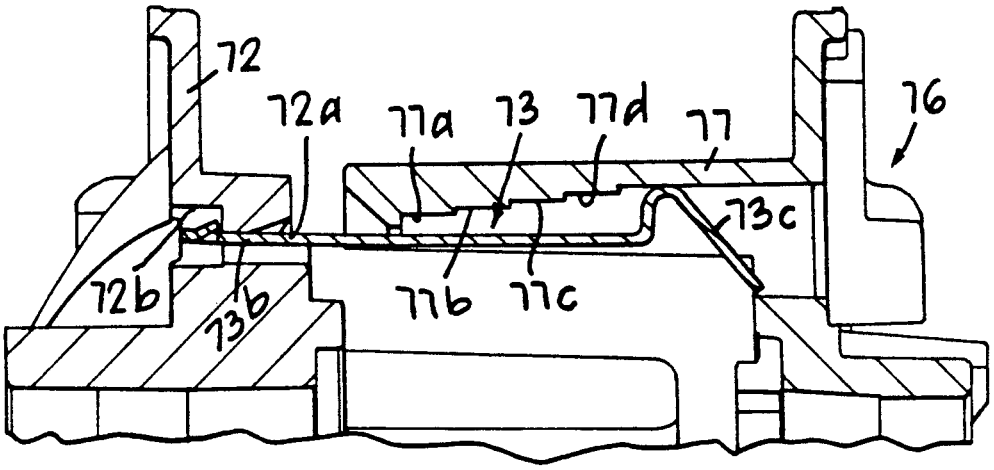
FIG. 14 is an elevational view of an alternative spring projection and mount.
Figure 14A:
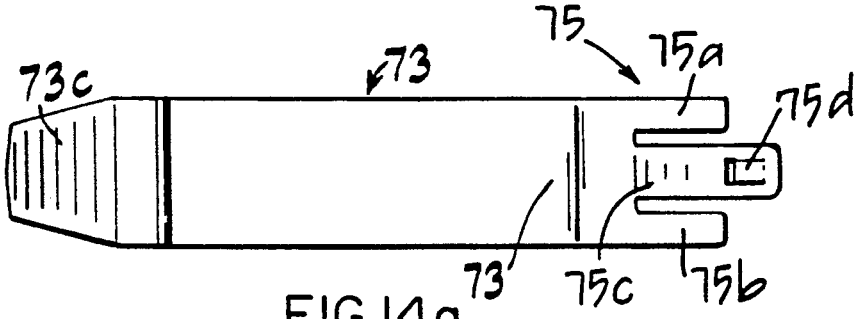
FIG. 14*a* is a plan view of the alternative spring projection.
Figure 14B:
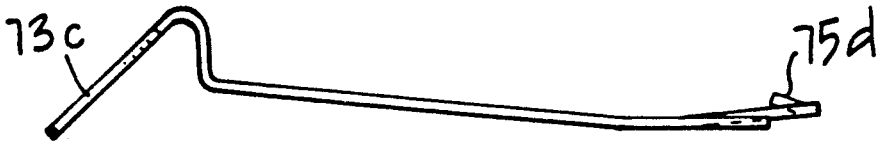
FIG. 14*b* is a side elevational view.

Turning to FIGS. 14, 14*a* and 14*b* there is shown a spring mount alternative to that shown in FIG. 3*a* in which outside housing 72 has channel 72*a* shaped to receive spring projection leg 73*b* of spring projection 73. Spring projection leg 73*b* comprises snap-in anchor portion 75 including side fingers 75*a*, 75*b*; center finger 75*c* and flexible detent 75*d*. Also shown is U-shaped projection head 73*c*; inside housing 76; grooved projection 77 and stop surfaces 77*a–d*. To assemble spring projection 73 into housing 72, anchor portion 75 is inserted into channel 72*a* causing detent 75*d* to flatten until it enters housing chamber 72*b* where it springs to lock position shown in FIG. 14.

We claim:

1. In a door set having two subassemblies each having housing plates for permanent assembly in which such housing plates are located a predetermined distance apart and are fastened together using fasteners and with a cylinder lock in one subassembly comprising a) engagement means for temporarily engaging said subassemblies during installation prior to engagement with such fasteners, said engagement means in turn comprising i) a first projection on an assembly which projection has a stop means at its end;

ii) a second projection on the other assembly which projection has a stop means at its end;

said stop means being engageable to prevent separation until a predetermined light force separates them and such stop means being spaced apart prior to such separation a predetermined distance such that the housing plates are spaced the same as or greater than the distance apart during said temporary engagement than after final installation with such fasteners.

2. The door set of claim 1 in which the first projection is rigid and the second projection is flexible.

3. The door set of claim 1 in which the secured projection has an anchor portion which snap-fits into the other assembly.

4. The door set of claim 2 in which the rigid projection has a plurality of stops to provide varying separation distances of the plates while the first and second projections are engaged.

5. The door set of claim 1 in which one subassembly has a turn button located in a sleeve with the button having a configured recess for receiving a turn bar having a configured end which bar is part of the other subassembly and in which the door set has a turn button flexible projection positioned in a slot in such sleeve with such button projection in an orientation determined by said flexible button projection projecting into such slot whereby the projection orients the button to receive the turn bar into its recess as assembly of the subassemblies occurs.

6. The door set of claim 1 in which one subassembly has a turn button with a configured recess for receiving a configured turn bar end with the turn button adaptor positioned in a slot apertured sleeve with such button adaptor in a orientation determined by a flexible button projection projecting into such slot whereby the projection orients the button adaptor for assembly of subassemblies.

7. The door set of claim 5 in which the button projection flexes after assembly to permit door set operation thereafter.

8. The door set of claim 5 in which the button projection after assembly is sheared off to permit door set operation thereafter.

9. In a door set having an outside subassembly including a stationary housing with a passageway therethrough and a ball-receiving cavity therein, a turn bar rotatable through a selected turning range; a cam connected to and rotatable with the bar, the improvement comprising a sleeve surrounding the cam and rotatable within the housing under a spring return force;

a slot opening in the sleeve normally positionable due to such spring force opposite the ball-receiving cavity;

a ball positioned in the slot opening and carried by the sleeve as it turns: and a cam pocket with a cam surface comprising part of the cam, said surface having a curved arcuate segment which surface when opposite said ball prevents such ball from moving out of ballreceiving cavity in the stationary housing whereby a selected rotation of the cam moves the ball through the slot into the housing cavity to lock the ball and rotation of the cam in the opposite direction through such arcuate segment is insufficient to allow the ball to commence moving out of the cavity.

10. The door set of claim 9 in which the curved segment arc is larger than the arc of rotation movement of the cam when caused to rotate to the full extent of its clearance and tolerance movement when locked and subjected to vibration.

* * * * *

UNITED STATES PATENT AND TRADEMARK OFFICE
CERTIFICATE OF CORRECTION

PATENT NO. : 5,171,049

DATED : December 15, 1992

INVENTOR(S) : Kenneth N. Grandy, Sr. and Dennis Resch

It is certified that error appears in the above-identified patent and that said Letters Patent is hereby corrected as shown below:

Title Page, assignment data omitted.

Should read --Assignee: MASTER LOCK COMPANY, Milwaukee, Wisconsin--.

Column 1, lines 15-16, "such assembled" should read --such assemblies--.

Column 2, line 1, "FIG. 11a-c" should read --FIGS. 11a-c--.

Column 3, line 46, "withdrawal of friction" should read --withdrawal of spindle 82, since washer tongues 84a, 84b tend to create friction--.

Column 4, line 12, "FIG. 11c" should read --FIG. 11a--.

Column 6, line 23, "ballreceiving" should read --ball-receiving--.

Signed and Sealed this

Twenty-third Day of November, 1993

*Attest:*

*Attesting Officer*

Bruce Lehman

BRUCE LEHMAN

*Commissioner of Patents and Trademarks*